US011564459B2

(12) United States Patent
Thompson et al.

(10) Patent No.: US 11,564,459 B2
(45) Date of Patent: Jan. 31, 2023

(54) BUCKLE ASSEMBLY

(71) Applicant: Central Lake Armor Express, Inc., Central Lake, MI (US)

(72) Inventors: Jesse Brian Thompson, North Bend, WA (US); Louis Welton Dawson, III, North Bend, WA (US); Kevin Ray Klemmt, Renton, WA (US)

(73) Assignee: Central Lake Armor Express, Inc., Arlington, VA (US)

( * ) Notice: Subject to any disclaimer, the term of this patent is extended or adjusted under 35 U.S.C. 154(b) by 0 days.

(21) Appl. No.: 17/217,223

(22) Filed: Mar. 30, 2021

(65) Prior Publication Data

US 2022/0312903 A1 Oct. 6, 2022

(51) Int. Cl.
*A44B 11/25* (2006.01)
*A44B 11/00* (2006.01)

(52) U.S. Cl.
CPC ..... *A44B 11/2588* (2013.01); *A44B 11/006* (2013.01)

(58) Field of Classification Search
CPC . A44B 11/258; A44B 11/2588; Y10T 24/342; F16B 45/06
See application file for complete search history.

(56) References Cited

U.S. PATENT DOCUMENTS 706,678 A * 8/1902 Moorman ..... F16B 45/06 24/598.5
4,470,176 A * 9/1984 Vermeulen ..... A44B 11/00 24/321
7,020,897 B2 4/2006 Johnson
7,424,748 B1 9/2008 McDunn et al.
7,987,523 B2 8/2011 Cole et al.
8,365,312 B2 2/2013 Herring
8,479,312 B2 7/2013 Dovner et al.
8,533,862 B2 9/2013 Khandelwal
8,572,762 B2 11/2013 Herbener et al.
8,608,041 B1 12/2013 Adkisson
8,808,048 B2 8/2014 Kent
8,898,814 B2 12/2014 Storms, Jr. et al.
D777,378 S 1/2017 Tien
(Continued)

FOREIGN PATENT DOCUMENTS

CN 305976103 S 8/2020
CN 307051802 1/2022
GB 2527327 A * 12/2015 ..... A44B 11/2588

*Primary Examiner* — Robert Sandy
(74) *Attorney, Agent, or Firm* — Inovue Advisors, LLC

(57) ABSTRACT

A buckle assembly includes a first frame member defining a first slot, which includes a first open end positioned at a first side of the first frame member and which includes a first closed end positioned spaced apart from a second side of the first frame member; a second frame member defining a second slot, which includes a second open end positioned at a second side of the second frame member and a second closed end positioned spaced apart from a first side of the second frame member, wherein one of the first or second frame members has a pivot member upon which the first and second frame members are rotatable relative to one another; and a third frame member defining at least two slots which extend through the third frame member and is configured to position within a recess defined within the second frame member.

20 Claims, 11 Drawing Sheets

(56) References Cited

U.S. PATENT DOCUMENTS

| | | | | |
|---|---|---|---|---|
| D781,000 | S | 3/2017 | Seuk | |
| 9,802,685 | B2 | 10/2017 | Kent | |
| D808,594 | S | 1/2018 | Tien | |
| 10,051,984 | B2 | 8/2018 | Buerck et al. | |
| 10,143,294 | B1 | 12/2018 | Matson et al. | |
| 10,281,240 | B2 | 5/2019 | Cole et al. | |
| D880,073 | S | 3/2020 | Groat | |
| 10,616,534 | B2 | 4/2020 | Thiel et al. | |
| 11,079,203 | B2 | 8/2021 | Becker et al. | |
| 11,098,982 | B2 | 8/2021 | Beck | |
| 11,109,664 | B2 | 9/2021 | LeMarbe | |
| 11,150,054 | B1 | 10/2021 | Bak | |
| D943,834 | S | 2/2022 | Siegieńczuk | |
| 11,291,274 | B2 * | 4/2022 | Seman | A45C 13/1069 |
| 2012/0084906 | A1 | 4/2012 | Sego, Jr. et al. | |
| 2012/0180178 | A1 | 7/2012 | Gallo | |
| 2012/0297527 | A1 | 11/2012 | Darnell et al. | |
| 2013/0312149 | A1 | 11/2013 | Asher et al. | |
| 2014/0262608 | A1 * | 9/2014 | Patel | F16B 45/06 24/592.11 |
| 2015/0342329 | A1 | 12/2015 | Formosa | |
| 2016/0021941 | A1 | 1/2016 | Jen | |

* cited by examiner

BUCKLE ASSEMBLY

FIELD

This disclosure relates to a buckle assembly, and more particularly to a buckle assembly used in securing a webbing or strap member in position with respect to a garment.

BACKGROUND

Numerous different configurations of buckle assemblies have been employed in securement of straps associated with securement of a garment to a wearer. It is desired in the selection of some buckle assembly configurations, the buckle assembly accommodate certain environmental considerations to which the buckle assembly is exposed during operation of the buckle assembly.

In one example, one operational environmental consideration for the buckle assembly is for the buckle assembly to have a compact and relatively low profile relative to the garment to which the buckle assembly is secured. This consideration may arise in use of a protective garment, for example, that is used in operations which places the garment coming in contact with the ground, in contact in areas of high vegetation growth or into contact with close quarters. These considerations arise, for example, where the wearer wears a protective garment which the wearer would have in a combat zone or a police officer would encounter in a law enforcement operation. There is a need for a buckle assembly to remain secured during operations so as to avoid any unwanted disengagement of the buckle assembly which could result in risking movement of the garment from a protective position to an non-protective position relative to the wearer.

A low profile configuration of the buckle assembly relative to the garment being secured reduces the risk of the buckle assembly becoming unintentionally disengaged and reduces the opportunity of the buckle assembly catching or snagging onto an environmental object proximate to the user, which may result in hampering the movement of the wearer.

There is a need to provide a buckle assembly which operates in a relatively close profile of the garment it secures so as to avoid coming into contact with environmental items which could disengage the buckle assembly and resulting in a protective garment being positioned in a non-optimal protective position. In addition, there is a need to provide a low profile buckle assembly or otherwise compact assembly so as to avoid undesired catching or snagging of the buckle assembly to an item in the wearer's proximal environment during operations, so as to avoid unnecessary hampering or hindering of movement of the wearer of the garment.

SUMMARY

A buckle assembly includes a first frame member defining a first slot, which includes a first open end positioned at a first side of the first frame member and which includes a first closed end positioned spaced apart from a second side of the first frame member. The assembly further includes a second frame member defining a second slot, which includes a second open end positioned at a second side of the second frame member and a second closed end positioned spaced apart from a first side of the second frame member, wherein one of the first or second frame members has a pivot member upon which the first and second frame members are rotatable relative to one another. The assembly further includes a third frame member, defining at least two slots which extend through the third frame, which is configured to position within a recess defined within the second frame member.

A method for securing a buckle assembly, includes the step of positioning one of a strap loop or a portion of a modular load carrying panel positioned between two adjacent slots within the modular load carrying panel, entrapped within a first slot of a first frame member and a second slot of a second frame member wherein, the first frame member and the second frame member are positioned in overlying relationship to one another. The method further includes threading a strap member through two slots defined within a third frame member and applying tension through the strap member to the third frame member positioning the third frame member into a recess defined in the second frame member.

DESCRIPTION

Figure 1:
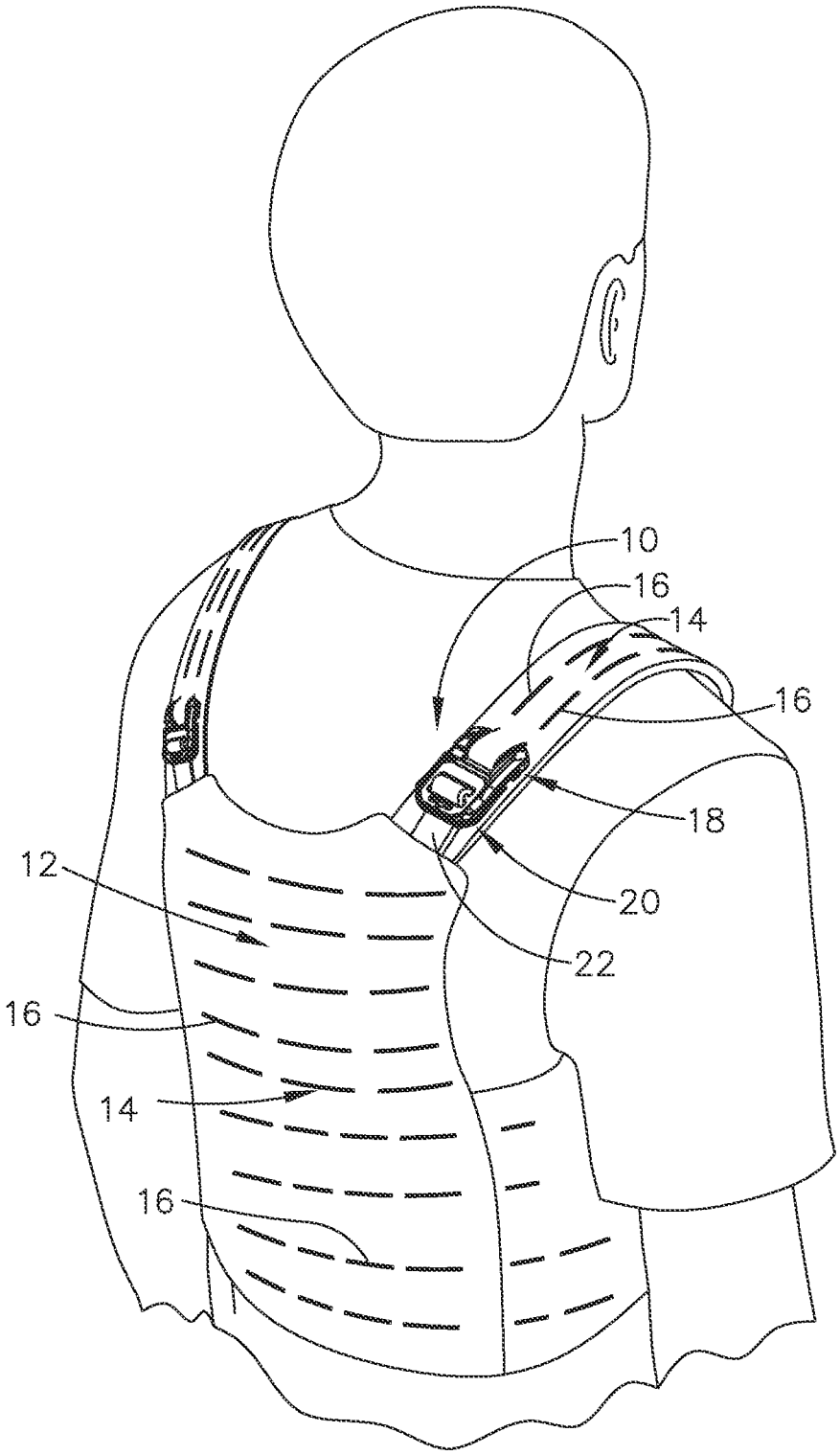
FIG. 1 is a perspective view of the buckle assembly in use on a back portion of a garment.

In referring to FIG. 1, an application of use for buckling assembly 10 can be seen. In this example of use, buckling assembly 10 is used in conjunction with ballistic carrier 12, which utilizes a modular load carrying panel 14 having a pattern of slots 16. Buckling assembly 10 has one end 18, in this example, secured to modular load carrying panel 14, which will be discussed if further detail herein and has a second end 20 secured to strap 22 which, is secured to ballistic carrier 12 (not shown). Buckle assembly 10 is understood to be usable as a buckling mechanism associated with many different items or garments. In the example discussed herein, buckling assembly 10 is used in association with ballistic carrier 12.

Figure 2:
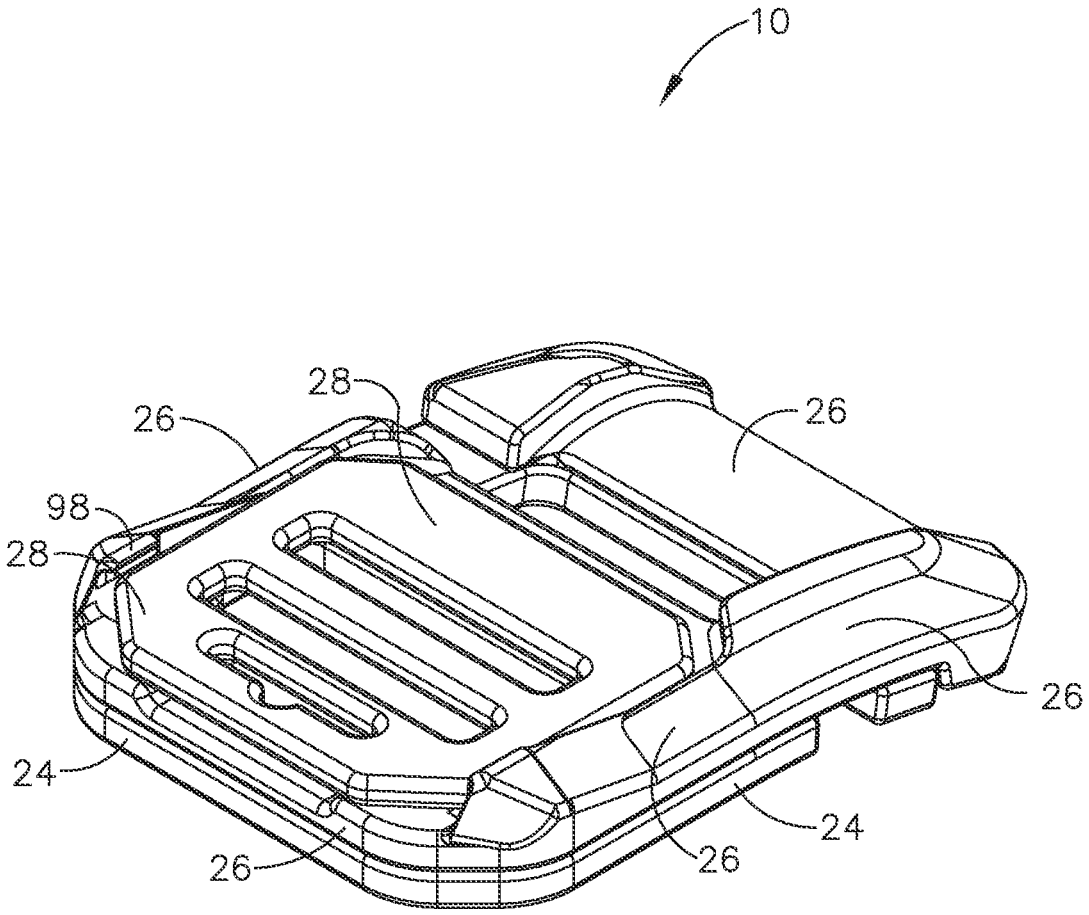
FIG. 2 is an enlarged perspective view of the buckle assembly in an assembled position, as seen in FIG. 1, without employment of straps with the buckle assembly.

In referring to FIG. 2, buckle assembly 10 is seen in an assembled and operational configuration, however, without being secured to straps or webbing associated with a garment to which buckle assembly 10 secures. Buckle assembly 10 includes first frame member 24 with second frame member 26 positioned in overlying relationship to first frame member 24. Third frame member 28 is positioned in overlying relationship with respect to second frame member 26. With first, second and third frame members 24, 26 and 28 in a stacked arrangement, as seen in FIG. 2, a compact and relatively low profile for buckle assembly 10 is provided.

Figure 3:
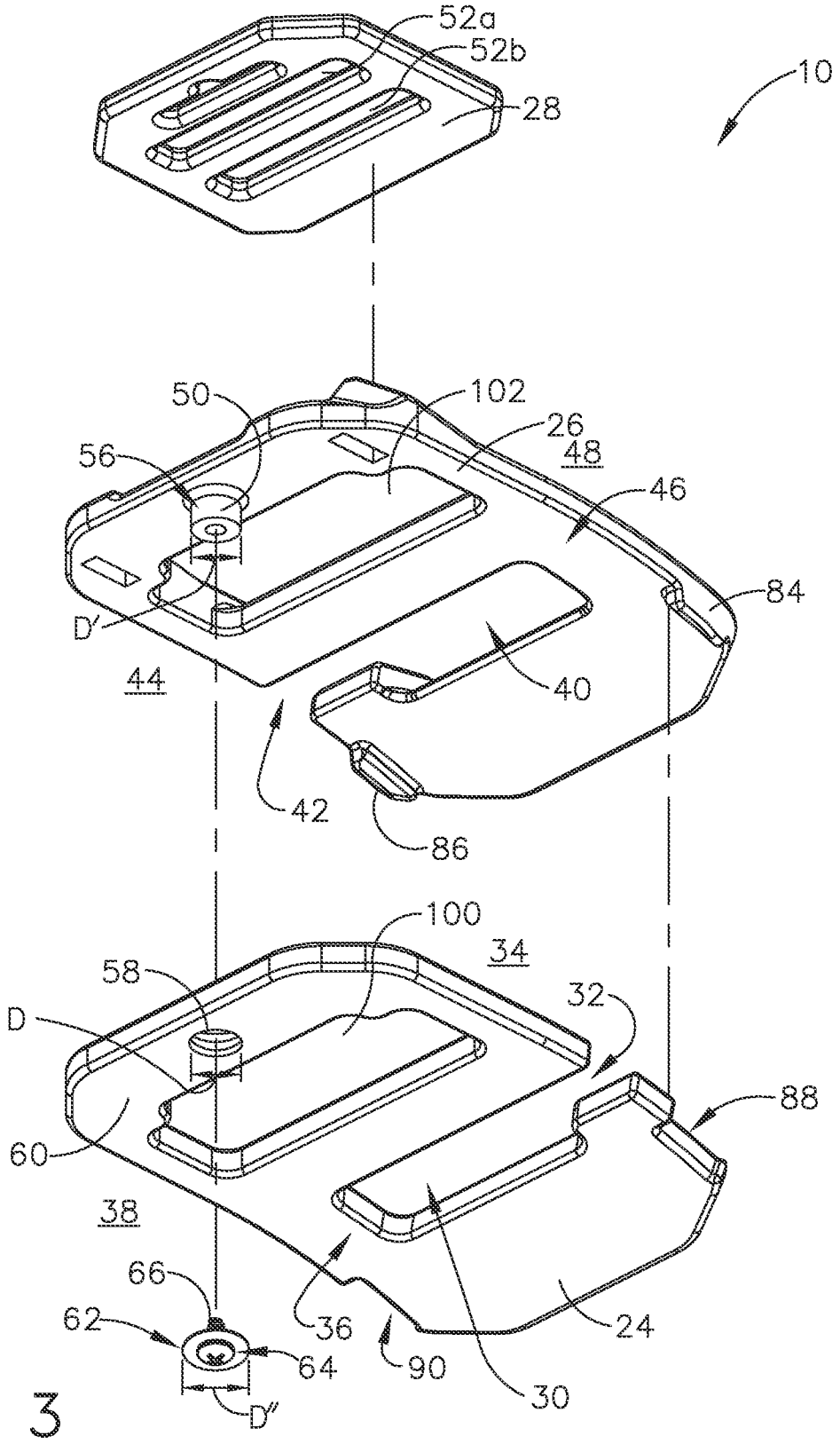
FIG. 3 is a bottom perspective exploded view of the buckle assembly of FIG. 2 with a first embodiment of a pivot member.
Figure 4:
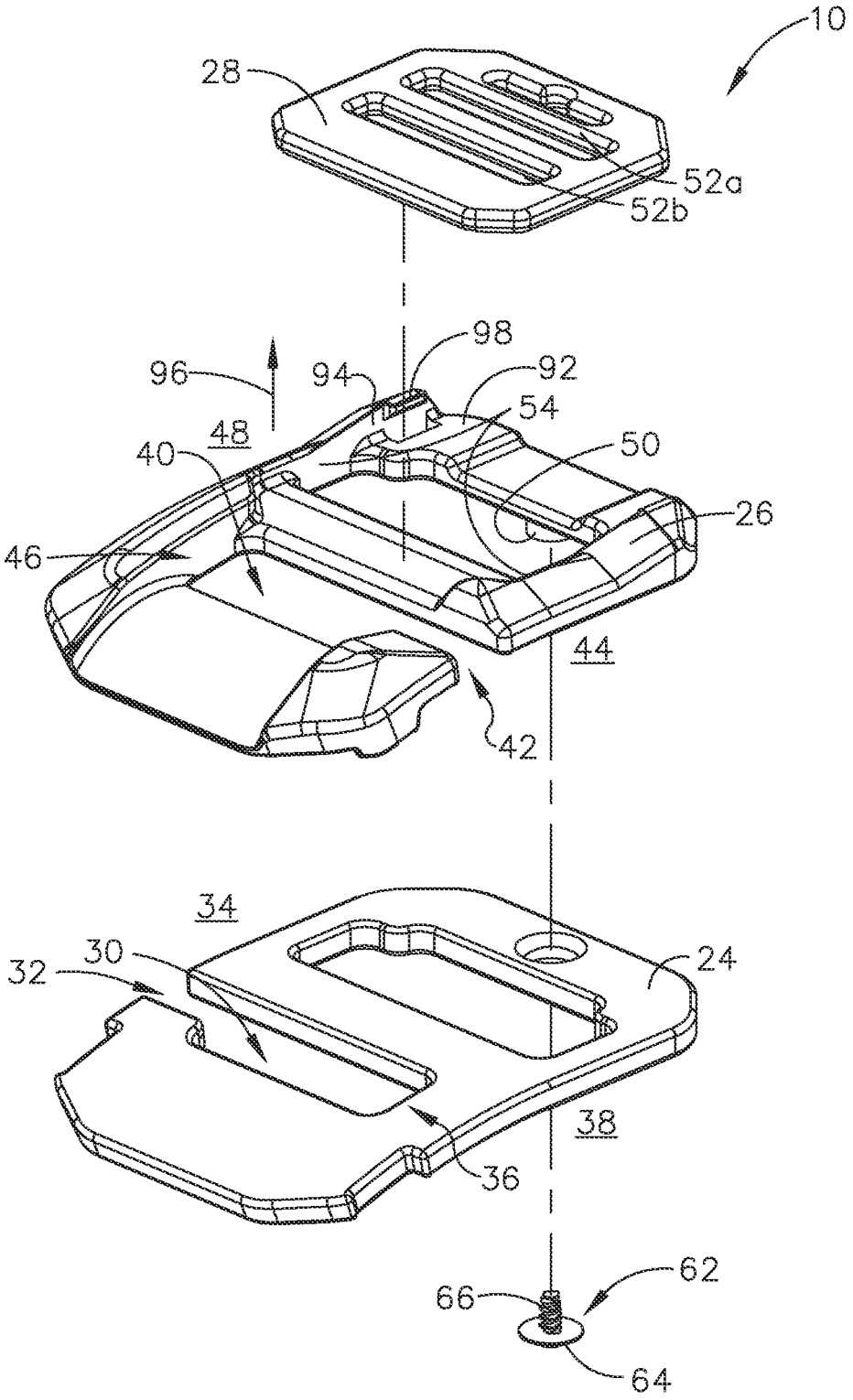
FIG. 4 is a top perspective exploded view of the buckle assembly of FIG. 2.

In referring to FIGS. 3 and 4, buckling assembly 10 can be seen in a bottom perspective exploded view and in a top perspective exploded view, respectively. First frame member 24 defines first slot 30, which includes first open end 32 at first side 34 of first frame member 24 and which includes first closed end 36 positioned spaced apart from second side 38 of first frame member 24. Second frame member 26 defines second slot 40, which includes second open end 42 at second side 44 of second frame member 26 and second closed end 46 of second slot 40 positioned spaced apart from first side 48 of second frame member 26. One of the first or second frame members 24, 26 has a pivot member 50 upon which first and second frame members 24, 26 are rotatable relative to one another. In this example, pivot member 50 is positioned on second frame member 26, which will be discussed in further detail herein. Third frame member 28 defines at least two slots 52*a* and 52*b*, which extend through third frame member 28. Third frame member 28 is configured to position within recess 54 defined within second frame member 26, which will be described in more detail.

As earlier mentioned, buckle assembly 10 can be used in many different applications, which in turn, may require the material from which buckle assembly 10 is constructed to vary so as to accommodate the particular application. For example, first frame member 24, in this example, is constructed of a metal, such as aluminum, or of a plastic. Second frame member 26 is constructed of plastic and third frame member is constructed of a metal such as aluminum. The composition of each frame member is based on the needed strength and flexibility of buckle assembly 10 for the particular application of use for buckle assembly 10.

Figure 12:
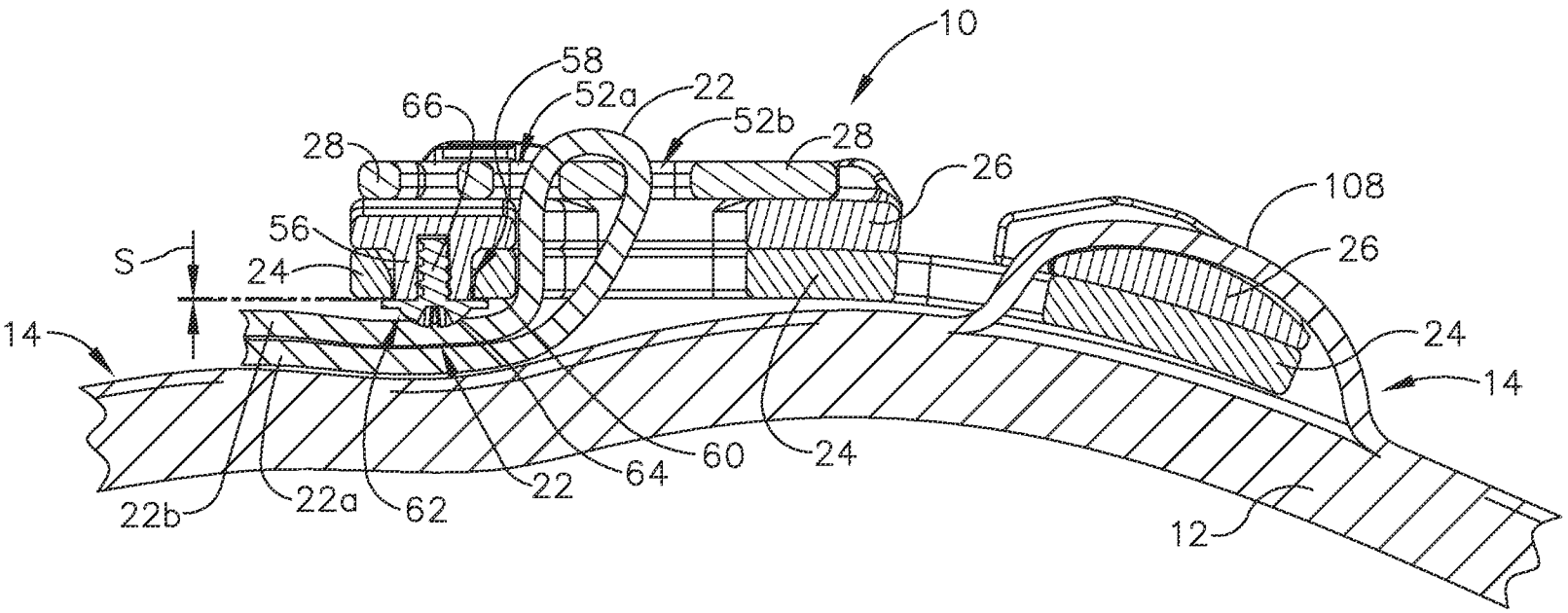
FIG. 12 is a cross section view of the second embodiment of securement of the buckle assembly along line 12-12 of FIG. 11.

As mentioned above, pivot member 50, in this example, is positioned on one of first frame member 24 or second frame member 26. In referring to FIG. 3, pivot member 50 includes pin member 56 which extends from second frame member 26 toward first frame member 24. First frame member 24 defines circular opening 58 which extends through first frame member 24, such that diameter dimension D of circular opening 58 is greater than diameter dimension D' of pin member 56. With second frame member 26 positioned in overlying relationship with first frame member 24, pin member 56 extends through circular opening 58 and extends beyond bottom surface 60 of first frame member 24. Screw 62, which includes head 64 with threaded shaft 66 extending from head 64, threaded shaft 66 engages pin member 56. With pin member 56 extending through circular opening 58 and threaded shaft 66 engaged to pin member 56, space S, as seen in FIG. 12, is provided between head 64, on the one hand, and pin member 56 and bottom surface 60 of first frame member 24, on the other hand, which allows user to not only rotate pin member 56 within circular opening 58, as desired, but also allows some movement of separation between first frame member 24 and second frame member 26. Diameter dimension D" of head 64 of screw 62 is greater than diameter dimension D of circular opening 58 of first frame member 24 preventing, in this example, complete separation of first frame member 24 from second frame member 26. This feature will be further appreciated with respect to threading of buckle assembly 10.

Figure 5:
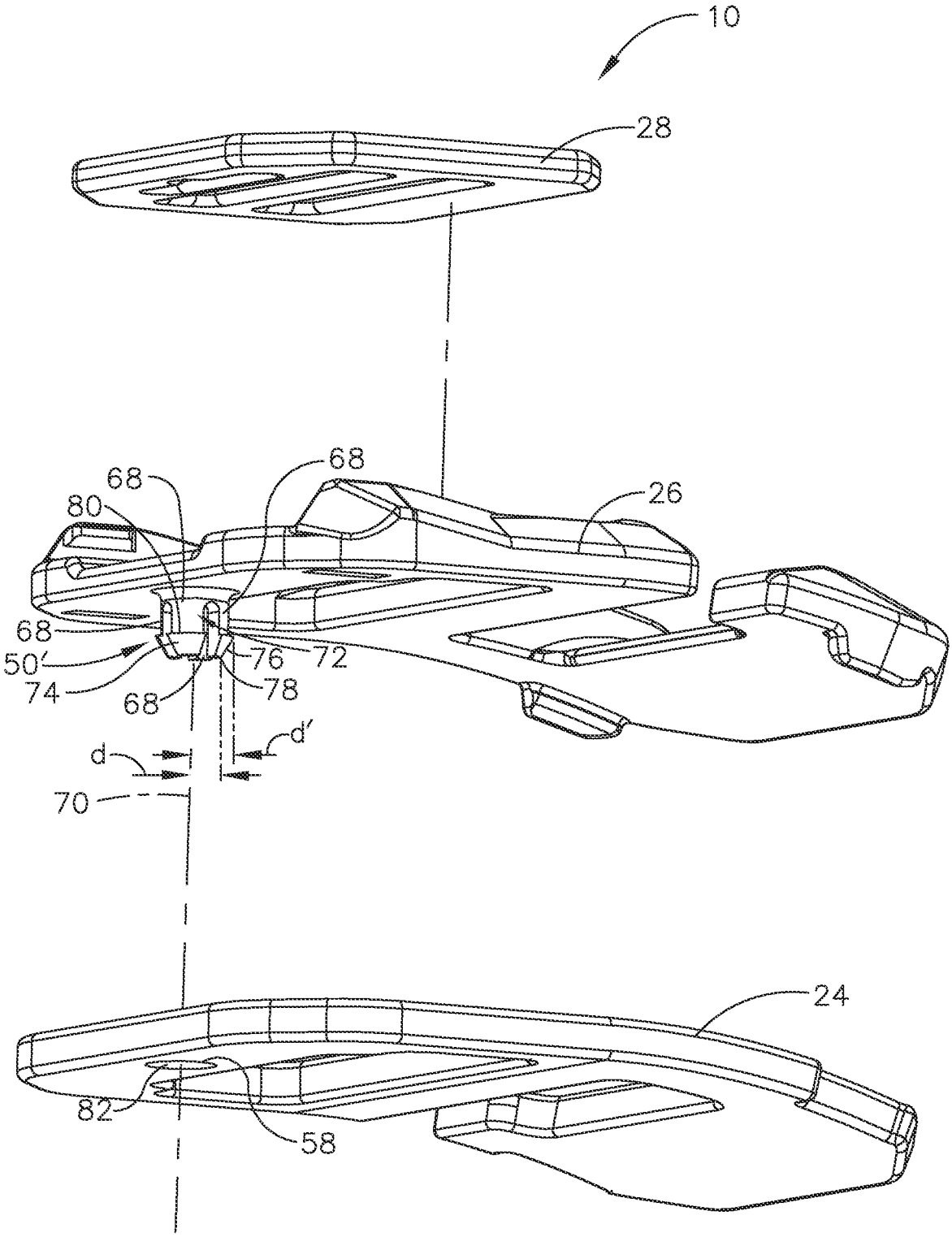
FIG. 5 is an exploded view of the buckle assembly of FIG. 2, with a second embodiment of a pivot member.

In referring to FIG. 5, buckling assembly 10 has a similar configuration of overlying third, second and first frame members 28, 26, and 24 as seen in FIGS. 3 and 4. In this example of FIG. 5, a different pivot member 50' is shown. Pivot member 50' similarly functions with respect to pivot member 50 of FIGS. 3 and 4, permitting rotational movement between first frame member 24 and second frame member 26 of FIG. 5 and allows and limits separation of first frame member 24 and second frame member 26 from one another. Pivot member 50' includes at least two leg members 68, in this example, four leg members 68 are shown, which extend from second frame member 26 toward first frame member 24. The at least two leg members 68 have central axis 70. In this example, four leg members 68 are shown positioned symmetrically about central axis 70.

Each of the at least two leg members 68 include leg portion 72 and head portion 74 with head portion 74 positioned further from second frame member 26 than leg portion 72. Each head portion 74 has a beveled surface 76 which has distal end 78 of beveled surface 76 positioned a distance "d" closer to the central axis 70 than a distance "d'" an opposing end 80 of beveled surface 76, which is positioned closer to the second frame member 26 than distal end 78 is positioned to second frame member 26.

With the at least two leg members 68, and in this example four leg members 68 inserted through circular opening 58 of first frame member 24, the at least two leg members 68 are configured such that opposing end 80 of beveled surface 76 of each of the at least two leg members 68 come into contact with an interior surface 82 causing interior surface 82 to apply a force on each of beveled surfaces 76 toward central axis 70. The application of this force results in the at least two leg members 68 to flex toward central axis 70.

With the opposing end 80 of beveled surface 76 of each of the at least two leg members 68 extending past bottom surface 60 of the first frame member 24, head portion 74 of each of the at least two leg members 68 extending past bottom surface 60 of first frame member 24, each of the at least two leg members 68 flex away from central axis 70 positioning each of the head portions 74, of the at least two leg members 68, in alignment with the bottom surface 60 of first frame member 24. With head portions 74 in alignment with bottom surface 60, head portions 74 block the at least two leg members 68 from passing through circular opening 58 which would permit complete separation of first frame member 24 and second frame member 26. Pivot member 50' functions similarly to pivot member 50 in that both permit rotation of first and second frame members 24, 26 relative to one another and both limit complete separation of first and second frame members 24, 26.

With buckle assembly 10 in operation as seen in FIG. 1, first, second, and third frame members 24, 26, and 28 are in a stacked overlying relationship to one another providing a relatively low profile with respect to ballistic carrier 14 without providing projections which would be susceptible to snagging or catching onto items in the environment of the wearer. One feature in this example of buckle assembly 10, which facilitates buckle assembly 10 maintaining a compact configuration and includes resisting undesired rotation of first frame member 24 relative to second frame member 26 during operation. With buckle member 10 in operation, resistance to undesired rotation of first and second frame members 24, 26 is provided for, in this example, with second frame member 26, as seen in FIG. 3, having first tab member 84 extending in a direction away from second frame member 26 with first tab member 84 positioned on second side 48 of second frame member 26. Second frame member 26 has second tab member 86 extending in a direction away from the second frame member 26 with second tab member 86 positioned on second side 44 of second frame member 26. With second frame member 26 positioned in overlying relationship with first frame member 24, first tab member 84 is positioned within first notch 88 defined by first frame member 24 and second tab member 86 is positioned within second notch 90 defined by first frame member 24 such that first tab member 84 and second tab member 86 restrict rotational movement of first frame member 24 relative to second frame member 26 about pivot member 50.

Additional features in the present example of buckle assembly 10 facilitate buckle assembly 10 maintaining a compact configuration during operation. Second frame member 26 further defines ledge 92, as seen in FIG. 4, which third frame member 28 contacts with third frame member 28 positioned in overlying relationship with second frame member 26. Second frame member 26 further includes wall member 94 which extends in a transverse direction 96 relative to ledge 92. Ledge 92 and wall member 94 provide recess 54 within second frame member 26. Recess 54 provides space in which third frame member 28 can occupy with third frame 28 positioned in overlying relationship with second frame member 26 with first, second and third frame members 24, 26, and 28 in operation. With buckle assembly 10 in operation, third frame member 28 is positioned within recess 54 maintaining third frame member 28 in a compact relationship with second frame member 26. With third frame member 28 positioned within recess 54 during operation, further resistance is provided so as to maintain third frame member 28 within recess 54 and from being unintentionally removed from recess 54. This resistance is accomplished in this example of buckle assembly 10 with second frame member 26 further including overhang tab 98 such that with third frame member 28 positioned within recess 54 overhang tab 98 blocks unintentional removal of third frame member 28 from second frame member 26, as seen in FIGS. 2 and 3. Overhang tab 98 is positioned over third frame member 28 in a blocking relationship inhibiting third frame member 28 from freely moving out of recess 54. These above discussed features facilitate buckle assembly 10 maintaining a desired compact configuration during operation of buckle assembly 10.

In furtherance of buckling assembly 10 maintaining a compact and relatively low profile, first frame member defines first opening 100, which extends through first frame member 24. Second frame member 26 defines second opening 102, which extends through second frame member 26. As seen in FIG. 3, with second frame member 26 in overlying relationship with first frame member 24, first opening 100 of first frame member 24 aligns with second opening 102 of second frame member 26. This pass through arrangement between first and second openings 100, 102 allows strap member 22 that is secured through slots 52*a* and 52*b* of third frame member 28 to pass through first and second frame members 24, 26 and beneath buckling assembly 10, as seen in FIG. 6.

Figure 6:
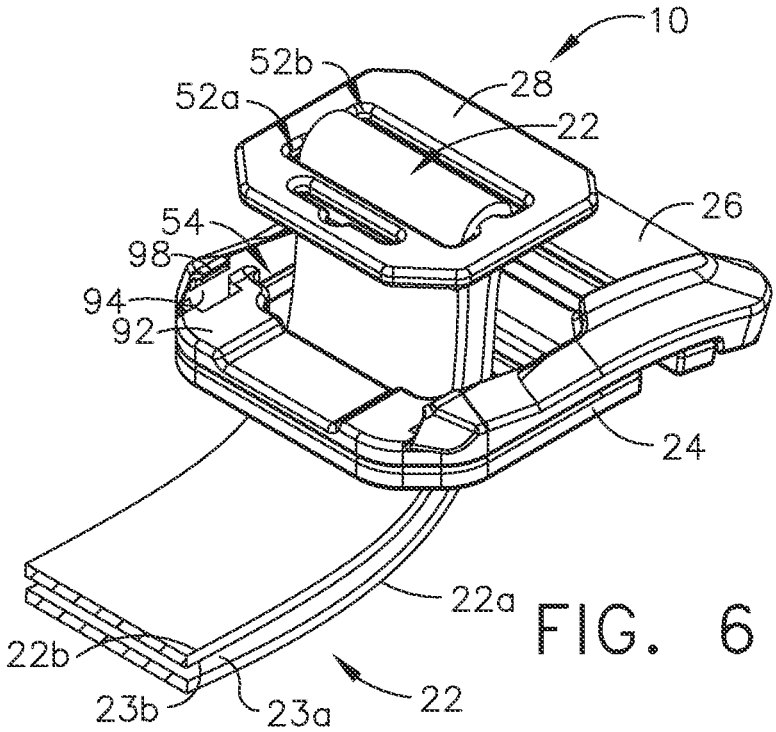
FIG. 6 is a perspective view of the buckle assembly of FIG. 2 with a strap member threaded through a third frame member of the buckle assembly with the third frame member positioned separated from a second frame member of the buckle assembly without tension applied to the first strap.
Figure 9:
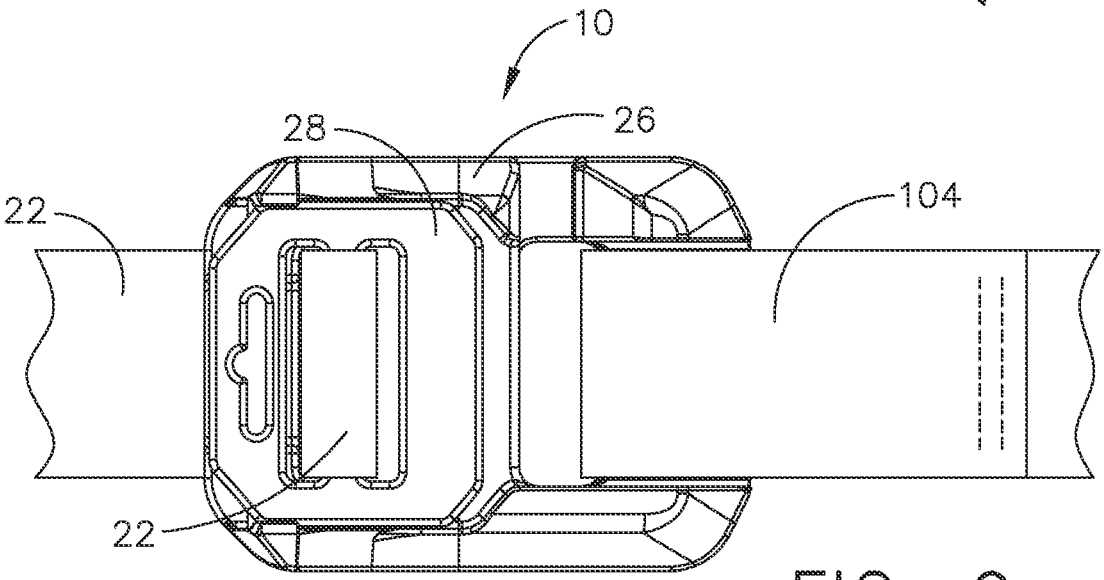
FIG. 9 is a top plan view of FIG. 8 with the first frame member rotated to a closed position such that the first and second frame members are in overlying relationship to one another entrapping the strap loop and the strap member is threaded through the third frame member with strap member under tension.
Figure 10:
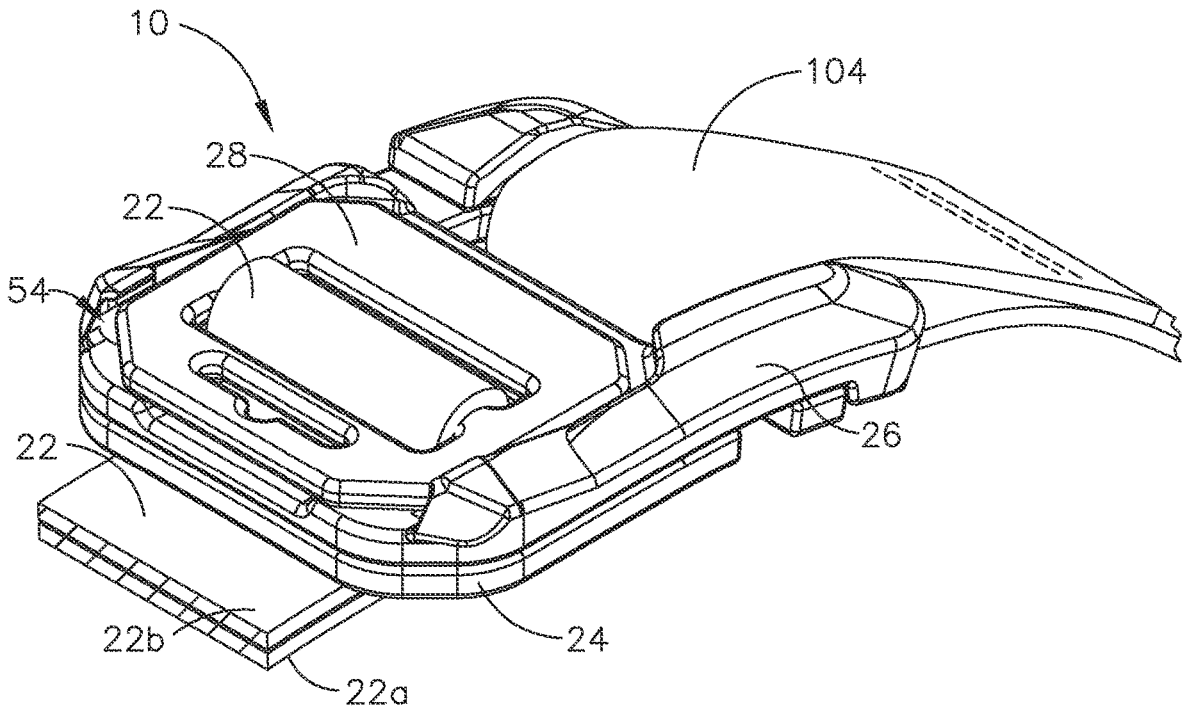
FIG. 10 is a perspective view of FIG. 9.
Figure 11:
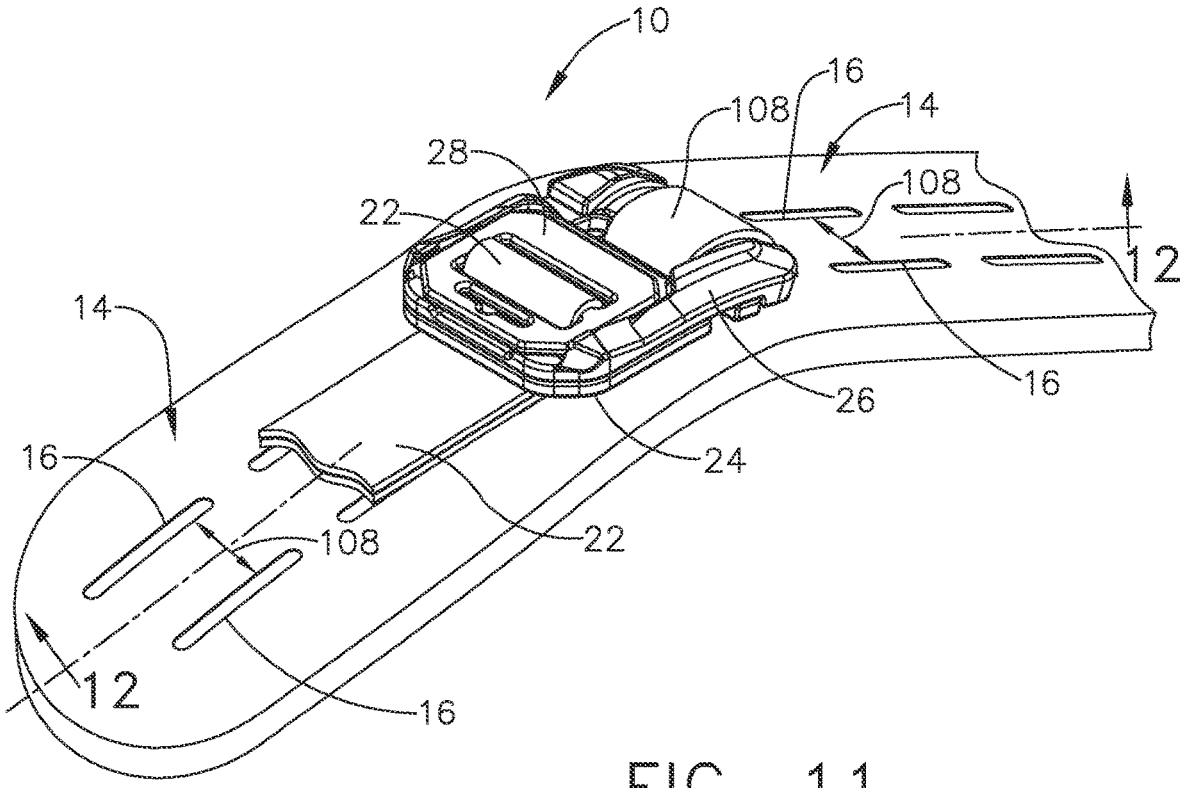
FIG. 11 is a second embodiment of securement of the buckle assembly to a garment with having the first frame member and the second frame member of the buckle assembly entrap a portion of the garment which is positioned between two adjacent modular load carrying slots of the garment.
Figure 13:
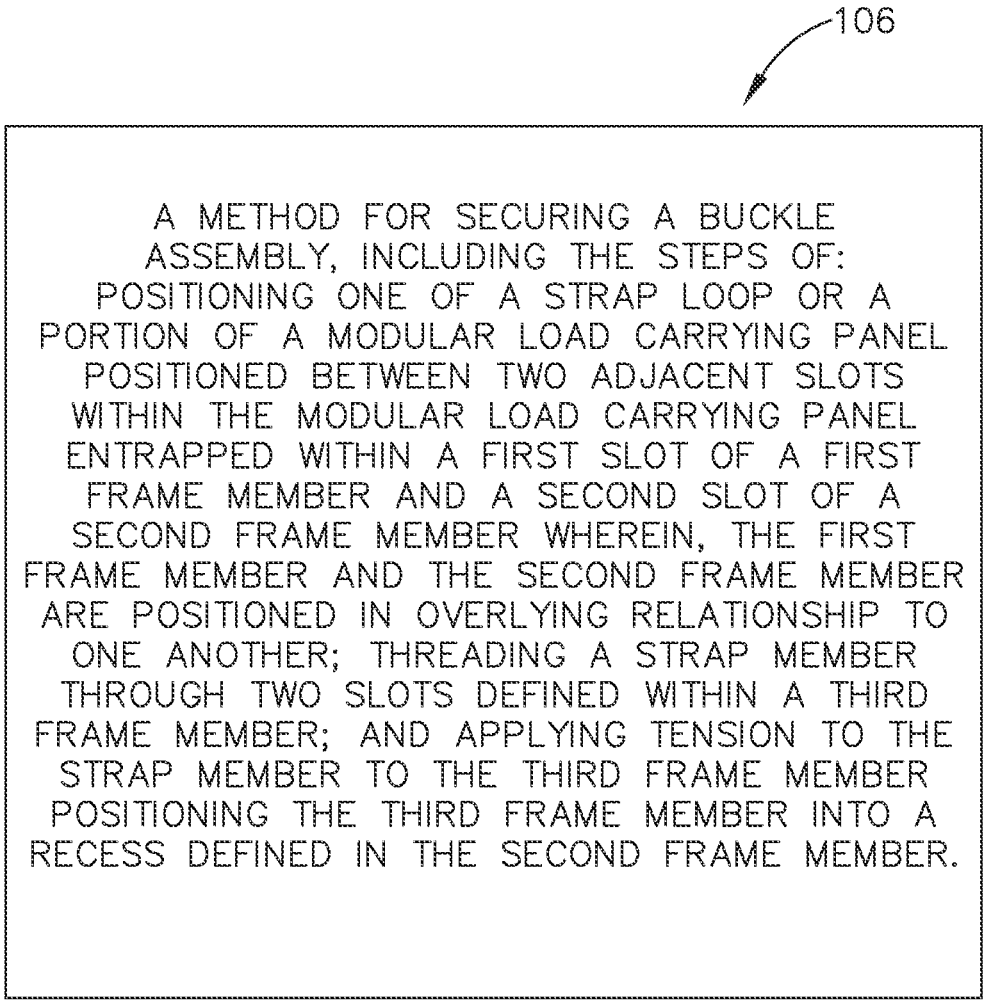
FIG. 13 is a method for securing the buckle assembly.

In referring to FIGS. 6-10 and 13, method 106, as seen in FIG. 13, includes a first embodiment of securing buckle assembly 10 and a second embodiment of securing buckle assembly 10 is shown with respect to FIGS. 11-13. In the first embodiment of securing buckle assembly 10 into an operational position, the first embodiment of securement buckle assembly 10 is seen in FIGS. 6-10 and with respect to method 106 of FIG. 13. In FIG. 6, first embodiment of securement includes threading strap member 22 through slots 52*a* and 52*b* of third frame member 28. Threading strap member 22 further includes placing strap member 22 to extend through first opening 100 of first frame member 24 and through second opening 102 in second frame member 26. This positions strap member 22 to extend beneath buckle assembly 10.

Strap member portion 22*a* is secured (not shown) to ballistic carrier 12 such as by way of being stitched to ballistic carrier 12. Strap portion 22*b* is movable relative to ballistic carrier 12. For example, a portion of strap member portion 22*a* carries a velcro-type material (not shown) on surface 23*a* of strap member portion 22*a* and strap member portion 22*b* carries a mating velcro-type material (not shown) on surface 23*b*, such that surfaces 23*a*, 23*b* face one another which allows the wearer to secure 22*a* and 22*b* together at a desired location in applying tension through strap 22 to third frame member 28. In FIG. 6 strap member portion 22*a* and 22*b* have not been secured together in a final securement position. At this point, third frame member 28 is outside of recess 54 of second frame member 26.

Figure 7:
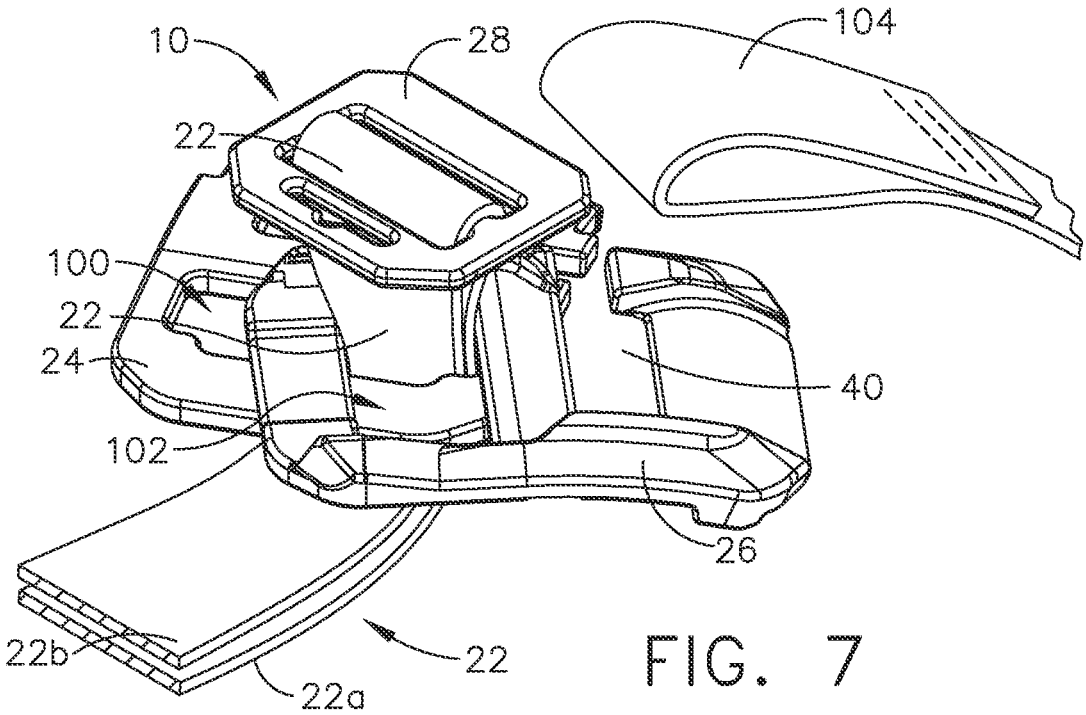
FIG. 7 is a perspective view of the buckle assembly of FIG. 6 with a first frame member and a second frame member of the buckle assembly rotated relative to one another with a strap loop positioned to be engaged within the first frame member and the second frame member.
Figure 8:
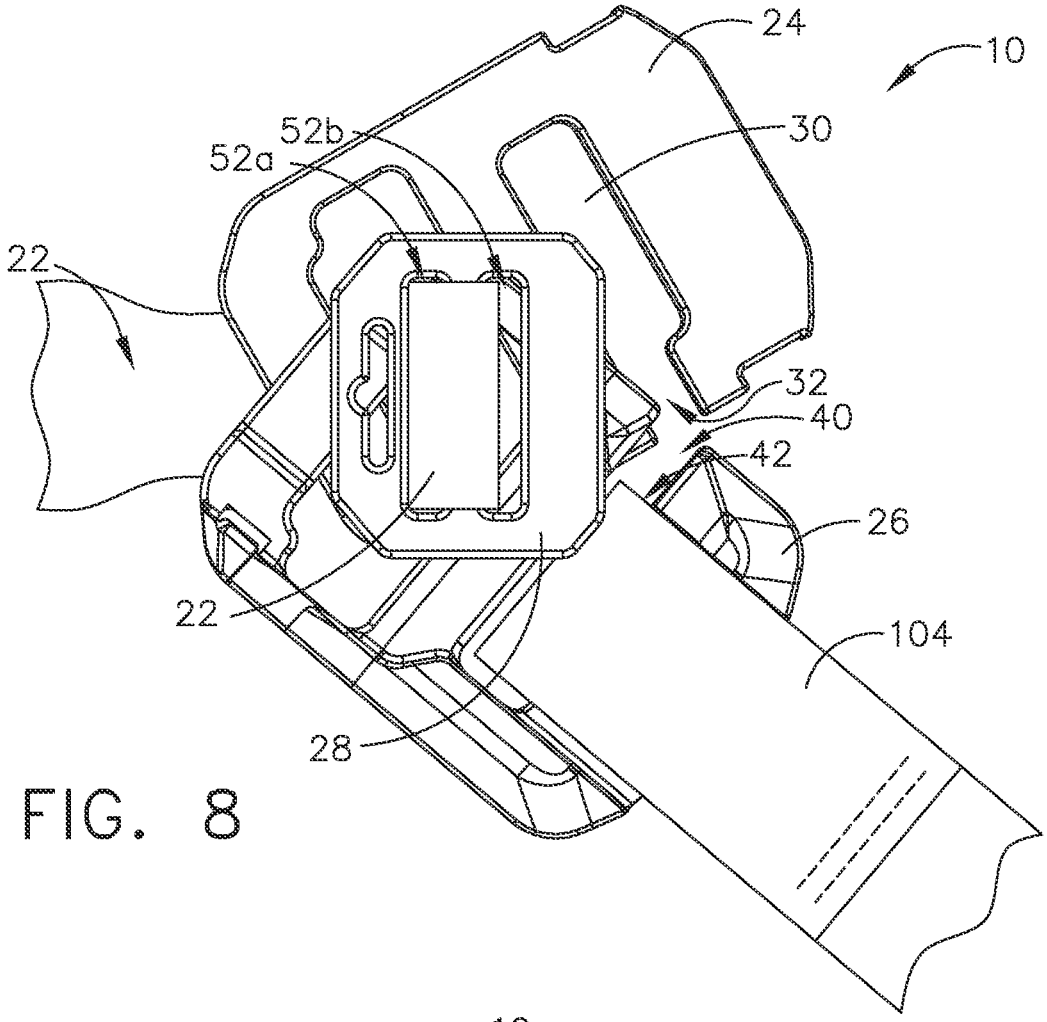
FIG. 8 is a top plan view of FIG. 7 with the strap loop positioned engaged within a second slot of the second frame member with the first frame member in an open position relative to the second frame member and the strap member threaded through slots positioned in the third frame member without tension applied to the first strap.

In FIGS. 7 and 8, strap loop 104 is, in this example secured (not shown) to ballistic carrier 12 at a location such that buckle assembly 10 can secure to strap loop 104. In preparation of securement of buckle assembly 10, method 106 includes positioning strap loop 104 to be entrapped within first slot 30 of first frame member 24 and second slot 40 of second frame member 26 with first frame member 24 and second frame member 26 positioned, as seen in FIGS. 9 and 10 in overlying relationship with one another. In FIG. 8 strap loop 104 is positioned within second slot 40 of second frame member 26.

In FIGS. 7 and 8, first and second frame members 24, 26 are rotated about pivot member 50, earlier shown, into an open position and allows strap loop 104 to be inserted into second slot 40 of second frame member 26. With rotation of first frame member 24 and second frame member 26 strap member 22, which extends through first opening 100 of first frame member 24 and second opening 102 of second frame member 26 as seen in also FIG. 3 is partially distorted, as seen in FIG. 7, with the rotation of first and second frame members 24, 26. As mentioned earlier, first and second frame members 24, 26 rotate about pivot member 50, which also permits first frame member 24 and second frame member 26 from fully separating from one another with rotation of first and second frame members 24, 26.

In referring to FIGS. 8-10, with strap loop 104 positioned within second slot 40 of second frame member 26, first and second frame members 24, 26 are rotated back into alignment with one another entrapping strap loop 104 within buckle assembly 10. Positioning of method 106 includes rotating first frame member 24 relative to second frame member 26 into overlying relationship to one another, as seen in FIGS. 8-10. This rotation is permitted, as discussed earlier, with one of the first or second frame members 24, 26 having a pivot member 50 upon which first and second frame members 24, 26 are rotatable relative to one another.

In this first embodiment of securing buckle assembly 10 of method 106, the wearer applies tension on strap member 22 to third frame member 28 which positions third frame member 28 into recess 54 defined in second frame member 26. In applying tension to strap 22, the wearer moves strap portion 22*b* along strap portion 22*a* until the wearer is comfortable with an adequate tension placed on buckle assembly 10. The wearer pushes strap portion 22*a* and strap portion 22*b* together such that velcro-like material positioned on surfaces 23*a* and 23*b* engages securing strap portion 22*a* and strap portion 22*b* together in a desired position for securement of the garment for the wearer. In this example, loop strap 104 securement to buckle assembly 10 provides a proximate positioning of buckle assembly 10 on the wearer. With buckle assembly 10 in a proximate position for securement, the final and more micro-positioned securement can be attained with the above-described application of a desired tension applied to buckle assembly 10 through strap member 22. The desired tension force applied through strap member 22 places third frame member 28 into recess 54 of second frame member 26. With adequate tension applied for properly securing the garment to the wearer, a desired securement is accomplished with buckle assembly 10 providing a compact and a low profile relative to the garment being secured.

In referring to FIGS. 11-13, a second embodiment of method 106 of securing buckle assembly 10 is shown. The second embodiment of method 106 of securing of buckle assembly 10 is similar to that described above with respect to the first embodiment of method 106 of securing of buckle assembly 10 as seen in FIGS. 6-10 except the second embodiment of securing buckle assembly 10 is without securement of buckle assembly 10 to strap loop 104 of the first embodiment of securing buckle assembly.

In this second embodiment of method 106 of securing buckle assembly 10, instead of securing buckle assembly 10 to strap loop 104, buckle assembly 10 is secured to modular load carrying panel 14 securing to portion 108 of modular load carrying panel 14 positioned between two adjacent slots 16 within modular load carrying panel 14 entrapped within first slot 30 of first frame member 24 and second slot 40 of second frame member 26. This entrapment can be seen for example in FIG. 8, where first and second frame members 24, 26 are rotated into an open position with first open end 32 of first frame member 24 and second open end 42 of second slot 40 are in an open unobstructed condition. In this open position, portion 108 of modular load carrying panel 14, as seen in FIG. 11 can be inserted into, for example, second slot 40 of second frame member 26 and first and second frame members 24, 26 can be rotated closed with respect to one another as similarly shown in FIGS. 8 and 9 for loop strap 104, with utilizing for example pivot member 50. With first and second frame members 24, 26 positioned in overlying relationship to one another, first portion 108 is entrapped within first slot 30 and second slot 40. Portion 108 as seen in FIG. 12, is positioned overlying second frame member 26 which in turn overlies first frame member 24. Portion 108 extends through first and second slots 30, 40 and is entrapped within first and second slots 30, 40. As a result, buckle assembly 10 is secured to modular load carrying panel 14. The wearer can select one of the portions 108, as seen in FIG. 11, to which to secure buckle assembly 10 so as to attain a proper fit for the wearer.

With portion 108 entrapped within first and second slots 30, 40 of first and second frame members 24, 26 respectively, buckle assembly 10 is, in this example, positioned in a desired proximate location for that wearer. Buckle assembly 10 is further secured to the wearer with application of tension applied by strap member 22 which passes through first and second openings 100, 102 of first and second frame members 24, 26 to third frame 28, as described earlier. With the adequate tension applied by way of strap member 22, third frame member 28 is positioned within recess 54 of second frame member 26 resulting in a compact and a low profile buckle assembly 10 which provides securement of the garment to the wearer.

While various embodiments have been described above, this disclosure is not intended to be limited thereto. Variations can be made to the disclosed embodiments that are still within the scope of the appended claims.

What is claimed:

1. A buckle assembly, comprising:

a first frame member defining a first slot, which includes a first open end positioned at a first side of the first frame member and which includes a first closed end positioned spaced apart from a second side of the first frame member;

a second frame member defining a second slot, which includes a second open end positioned at a second side of the second frame member and a second closed end positioned spaced apart from a first side of the second frame member, wherein one of the first or second frame members has a pivot member upon which the first and second frame members are rotatable relative to one another; and a third frame member defining at least two slots which extend through the third frame member, which is configured to position within a recess defined within the second frame member.

2. The buckle assembly of claim 1, wherein the first frame member is constructed of a metal or a plastic.

3. The buckle assembly of claim 1, wherein the second frame member is constructed of plastic.

4. The buckle assembly of claim 1, wherein the third frame member is constructed of a metal.

5. The buckle assembly of claim 1, wherein, the pivot member comprises a pin member extending from the second frame member toward the first frame member.

6. The buckle assembly of claim 5, wherein, the first frame member defines a circular opening, which extends through the first frame member, such that a diameter dimension of the circular opening is greater than a diameter dimension of the pin member.

7. The buckle assembly of claim 6, wherein, with the second frame member positioned in overlying relationship to the first frame member, the pin member extends through the circular opening and beyond a bottom surface of the first frame member;

a screw, which includes a head with a threaded shaft extending from the head, engages the pin member; and a diameter dimension of the head of the screw is greater than the diameter dimension of the circular opening.

8. The buckle assembly of claim 1, wherein:

the pivot member comprises at least two leg members which extend from the second frame member toward the first frame member with the at least two leg members having a central axis;

each of the at least two leg members comprises a leg portion and a head portion with the head portion positioned further from the second frame member than the leg portion, wherein:

each head portion has a beveled surface which has a distal end of the beveled surface positioned a distance closer to the central axis than a distance an opposing end of the beveled surface, which is positioned closer to the second frame member than the distal end is positioned to the second frame member;

with the at least two leg members inserted through a circular opening defined through the first frame member, the opposing end of the beveled surface of each of the at least two leg members comes into contact with an interior surface of the circular opening and applying a force on each of the beveled surfaces toward the central axis; and with the opposing end of the beveled surface of each of the at least two leg members extending past a bottom surface of the first frame member, each of the at least two leg members move in a direction away from the central axis positioning each of the head portions, of the at least two leg members, in alignment with the bottom surface of the first frame member.

9. The buckle assembly of claim 1, wherein:

the second frame member has a first tab member extending in a direction away from the second frame member with the first tab member positioned on the first side of the second frame member;

the second frame member has a second tab member extending in a direction away from the second frame member with the second tab member positioned on the second side of the second frame member;

with the second frame member positioned in overlying relationship with the first frame member, the first tab member is positioned within a first notch defined by the first frame member and the second tab member is positioned within a second notch defined by first frame member such that the first tab member and the second tab member restrict rotational movement of the first frame member relative to the second frame member.

10. The buckle assembly of claim 1, wherein the first frame member defines a first opening which extends through the first frame member.

11. The buckle assembly of claim 10, wherein the second frame member defines a second opening which extends through the second frame member.

12. The buckle assembly of claim 11, wherein with the second frame member in overlying relationship with the first frame member, the first opening of the first frame member aligns with the second opening of the second frame member.

13. The buckle assembly of claim 1, the second frame member further defines a ledge, which the third frame member contacts with the third frame member in overlying relationship with the second frame member.

14. The buckle assembly of claim 13, wherein the second frame member further includes a wall member extending in a transverse direction relative to the ledge.

15. The buckle assembly of claim 14, wherein the ledge and the wall member provide a recess within the second frame member in which the third frame member is positioned with the third frame positioned in overlying relationship with the second frame member.

16. The buckle assembly of claim 15, wherein the second frame member further includes an overhang tab such that with the third frame member positioned within the recess the overhang tab is positioned over the third frame member.

17. The buckle assembly of claim 1, with first frame member and second frame member in overlying relationship to one another, the first slot defined by the first frame member and the second slot defined by the second frame member, entrap a portion of a modular load carrying panel, which is positioned between two adjacent slots defined in the modular load carrying panel.

18. A method for securing a buckle assembly, comprising the steps of:

positioning one of a strap loop or a portion of a modular load carrying panel positioned between two adjacent slots within the modular load carrying panel, entrapped within a first slot of a first frame member and a second slot of a second frame member wherein, the first frame member and the second frame member are positioned in overlying relationship to one another;

threading a strap member through two slots defined within a third frame member;

applying tension to the strap member places the third frame member into a recess defined in the second frame member.

19. The method of claim 18, wherein positioning includes rotating the first frame member relative to the second frame member into overlying relationship to one another, with one of the first or second frame members having a pivot member upon which the first and second frame members are rotatable relative to one another.

20. The method of claim 18, wherein threading the strap member further includes placing the strap member to extend through a first opening in the first frame member and through a second opening in the second frame member.

* * * * *